United States Patent [19]

Okada

[11] Patent Number: 4,556,140

[45] Date of Patent: Dec. 3, 1985

[54] METHOD AND APPARATUS FOR DISCRIMINATING COINS OR BANK NOTES

[75] Inventor: Kazuo Okada, Tokyo, Japan

[73] Assignee: Kabushiki Kaisha Universal, Tochigi, Japan

[21] Appl. No.: 521,381

[22] Filed: Aug. 8, 1983

[30] Foreign Application Priority Data

Aug. 6, 1982 [JP] Japan ..... 57-136305

[51] Int. Cl.[4] ..... G07F 7/04

[52] U.S. Cl. ..... 194/4 C; 194/100 A

[58] Field of Search ..... 194/100 A, 4 C, 100 R, 194/4 R, 101, 102; 209/534

[56] References Cited

U.S. PATENT DOCUMENTS 3,738,469 6/1973 Prumm ..... 194/101
4,117,539 9/1978 Bell et al. ..... 364/551
4,179,685 12/1979 O'Maley ..... 209/534
4,249,648 2/1981 Meyer ..... 194/102
4,354,587 10/1982 Davies ..... 194/100 A

*Primary Examiner*—Stanley H. Tollberg
*Attorney, Agent, or Firm*—Young & Thompson

[57] ABSTRACT

A method and apparatus for discriminating coins or bank notes, in which sensors measure characteristics of coins or bank notes. Processing control apparatus provides a reference value setting mode and a discrimination mode. In the reference value setting mode, data of sample coins or bank notes obtained from the sensors are statistically processed to calculate minimum and maximum reference values, and these values are stored in a memory. In the discimination mode, a coin or bank note to be authenticated is checked as to whether its characteristics are within the range of minimum and maximum reference values. Genuine coins or bank notes are automatically separated from counterfeit.

13 Claims, 5 Drawing Figures

FIG. 3

| | SIZE REFERENCE AREA | | FIRST MATERIAL REFERENCE AREA | | SECOND MATERIAL REFERENCE AREA | |
|---|---|---|---|---|---|---|
| | MINIMUM REFERENCE VALUE | MAXIMUM REFERENCE VALUE | MINIMUM REFERENCE VALUE | MAXIMUM REFERENCE VALUE | MINIMUM REFERENCE VALUE | MAXIMUM REFERENCE VALUE |
| KIND 1 | " | " | " | " | " | " |
| KIND 2 | " | " | " | " | " | " |
| KIND 3 | " | " | " | " | " | " |
| | | | | | | |

METHOD AND APPARATUS FOR DISCRIMINATING COINS OR BANK NOTES

BACKGROUND OF THE INVENTION

This invention relates to a method and apparatus for discriminating coins (which includes tokens) or bank notes or the like used for automatic vending machines, game machines, money changing machines, etc. and, more particularly, to a method and apparatus for discriminating coins or bank notes, in which specific data of a coin or bank note to be discriminated, i.e., data representing the shape, characteristics of material, pattern, etc., are obtained for a given number of sample coins or bank notes and statistically processed to obtain reference values in advance so that the discrimination of coins or bank notes with respect to the genuineness thereof is performed with reference to the reference values.

Automatic vending machines, money changing machines, game machines and like machines usually use an apparatus for discriminating the kind and genuineness of the inserted coins or bank notes. Especially, game machines are constructed to receive a fixed denomination of coin (e.g., the 100-yen coin in Japan). However, different coins, both in shape and material, are used in different countries. Therefore, when exporting game machines to different countries, respectively different coin discriminating apparatus must be provided, which is very inconvenient from the standpoint of the manufacture.

Furthermore, in the case of a machine in which a plurality of different kinds of coins are received, the corresponding number of coin discriminating devices, each for discriminating a particular kind of coin, must be provided serially. Doing so inevitably increases the size of the machine. This drawback arises from the fact that in the machines receiving a plurality of different kinds of coins, a corresponding number of gages each corresponding to the size of a particular kind of coin are provided, such that a coin is passed for discrimination through these gages in succession. In the prior art discriminating apparatus, the discrimination is done through comparison with a preset reference value. Where a plurality of different discriminations are performed, the corresponding number of different gages are then necessary, so that the overall discriminating apparatus is complicated in construction and increased in size.

Apparatus for discriminating bank notes usually uses optical or magnetic sensors. Again in this case, the reference values for discrimination are preset. That is, different bank note discriminating devices must be provided for different countries where different kinds of bank notes are used. Furthermore, when a new kind of bank note is issued, considerable time and expense are necessary to provide machines which receive the new bank notes.

OBJECTS OF THE INVENTION

The primary object of the invention is to provide a discriminating method and apparatus, which can discriminate different kinds of coins or bank notes with the same sensors.

Another object of the invention is to provide a discriminating method and apparatus, which can be readily adapted to discriminate new issues of coins or bank notes.

A further object of the invention is to provide a discriminating method and apparatus, which can perform discrimination without being adversely affected by fluctuations, if any, of the precision of sensors for measuring the characteristics of coins or bank notes.

A still further object of the invention is to provide a discriminating apparatus which can be manufactured at low cost.

SUMMARY OF THE INVENTION

The above and further objects, features and advantages of the invention are attained by the provision of sensors for measuring characteristics such as the shape and material of coins or bank notes, processing control means for processing the characteristic data measured by the sensors, and memory means for storing the results of processing. In a reference value setting mode, characteristic data of a given number of sample coins of the same denomination are obtained from the sensors, and reference values are obtained from the obtained characteristic data. The reference values are stored in the memory means. In a discrimination mode, which is set after the reference values have been set, characteristic data of inspected coins are obtained from the sensors in the same manner as in the reference value setting mode. These data are compared with the reference values stored in the memory means to discriminate the inspected coins.

With the method and apparatus according to the invention, different inspected objects can be discriminated with respect to their authenticity with a single apparatus. This is very convenient for manufacture, and thus permits great rationalization of the manufacture and management and great cost reduction.

Furthermore, since the same sensors used for the setting of the reference values are used for the inspection, the inspected coin can be discriminated without any adverse effect of fluctuations of the characteristics of the sensors.

Still further, since the setting of the reference values is done electrically, the number of inspected items can be readily varied. Particularly, when adding extra items for inspection, the size of the equipment need be increased only by an amount corresponding to the total size of the additional sensors. Thus, it is possible to obtain a discriminating apparatus, which is compact in construction and has high performance and high versatility compared to the prior art devices.

Finally, since the apparatus has no initially preset reference values, but can be adapted to discriminate any kind of object, machines using it can be shipped to even small markets in overseas countries without any cost increase.

BRIEF DESCRIPTION OF THE DRAWINGS

FIG. 3 is a view showing the memory map of a RAM shown in FIG. 1;

DETAILED DESCRIPTION OF THE INVENTION

Figure 1:
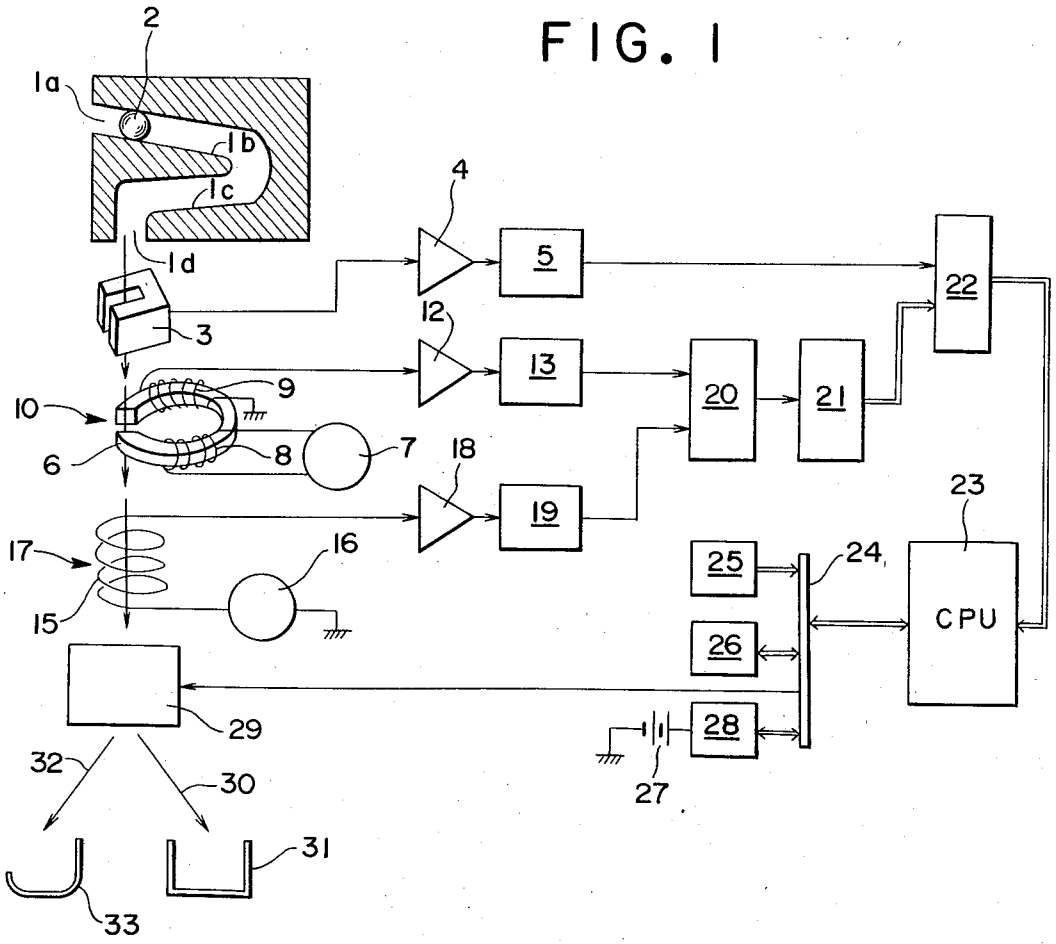
FIG. 1 is a block diagram showing an embodiment of the invention.

FIG. 1 illustrates a coin discriminating apparatus used for a game machine. A coin (or token) 2 inserted into a coin slot 1*a* is led along gently inclined guides 1*b* and 1*c*. As it is led along these guides 1*b* and 1*c*, its speed is controlled so that it can fall from an outlet 1*d* substantially at the speed of its natural fall irrespective of the speed at which it is inserted into the coin slot 1*a*. The coin 2 falling from the outlet 1*d* is detected by various sensors under fixed conditions. The guides 1*b* and 1*c* may be provided with soft buffering members to enhance the braking effect noted.

The coin falling substantially naturally from the outlet 1*d* passes through a photosensor 3 consisting of a photocoupler having a light-emitting section and a light-receiving section facing each other. As the coin 2 falls through the photosensor 3, light emitted from the light-emitting section is blocked by it and does not reach the light-receiving section. Thus, the size (or shape) of the inserted coin 2 can be detected from the relation between the light blocking period and the speed of fall. The output of the photosensor 3 is fed through an amplifier 4 and a waveform shaper 5 to produce a pulse having the same duration as the light blocking period noted above.

The coin having passed through the photosensor 3 then passes through a gap in a ferrite core 6. The ferrite core 6 has a coil 8, to which an AC current is supplied from an oscillator 7, and a coil 9, which detects a change in the magnetic reluctance in the magnetic circuit consisting of the ferrite core 6. The ferrite core 6, oscillator 7 and coils 8 and 9 form a magnetic sensor 10. As a result of the change in the magnetic reluctance of the magnetic circuit caused by the passage of the coin through the gap of the ferrite core 6, the voltage induced across the coil 9 is varied. Thus, any magnetic material of the coin 2 can be detected. The output of the coil 9 is fed through an amplifier 12 and rectifier 13 for rectification.

The coin 2 having passed through the gap noted above then passes through a second magnetic sensor 17 consisting of a coreless coil 15 and an oscillator 16. The oscillator 16 supplies a high frequency current to the coil 15. An eddy current loss is thus produced by the passage of the coin 2 through the coil 15, so that any magnetic material of the coin 2 can be detected. The output of the coil 15 is fed through an amplifier 18 and a rectifier 19 for rectification.

The data outputs of the magnetic sensors 10 and 17 are fed through a multiplexer for conversion to serial data, which is fed to an analog-to-digital (A/D) converter 21. The digital data output of the A/D converter 21, obtained from the data outputs of the magnetic sensors 10 and 17, and the data output of the photosensor 3 are fed to a second multiplexer 22, which provides a serial data output which is read into a microprocessor 23. The microprocessor 23 is connected to a bus line 24. To the bus line 24 is connected a control switch section 25. The switch section 25 can set a reference value setting mode or a discrimination mode, and also it can set a sample number in the reference value setting mode. To the bus line 24 is also connected a ROM (read-only memory) 26 in which programs are stored. To the bus line 24 is further connected a RAM (random access memory) 28. The RAM 28 stores reference value data obtained from the data read into the microcomputer 23 noted above through a processing to be described later. It can be furnished with power from a back-up battery 27 in case of commercial power loss. The bus line 24 is further connected to a gate mechanism 29, which either accepts the coin 28 falling through it as a genuine coin or rejects the coin. The gate mechanism 29 consists of a solenoid and a flap driven thereby to switch between two passages 30 and 32.

Figure 2:
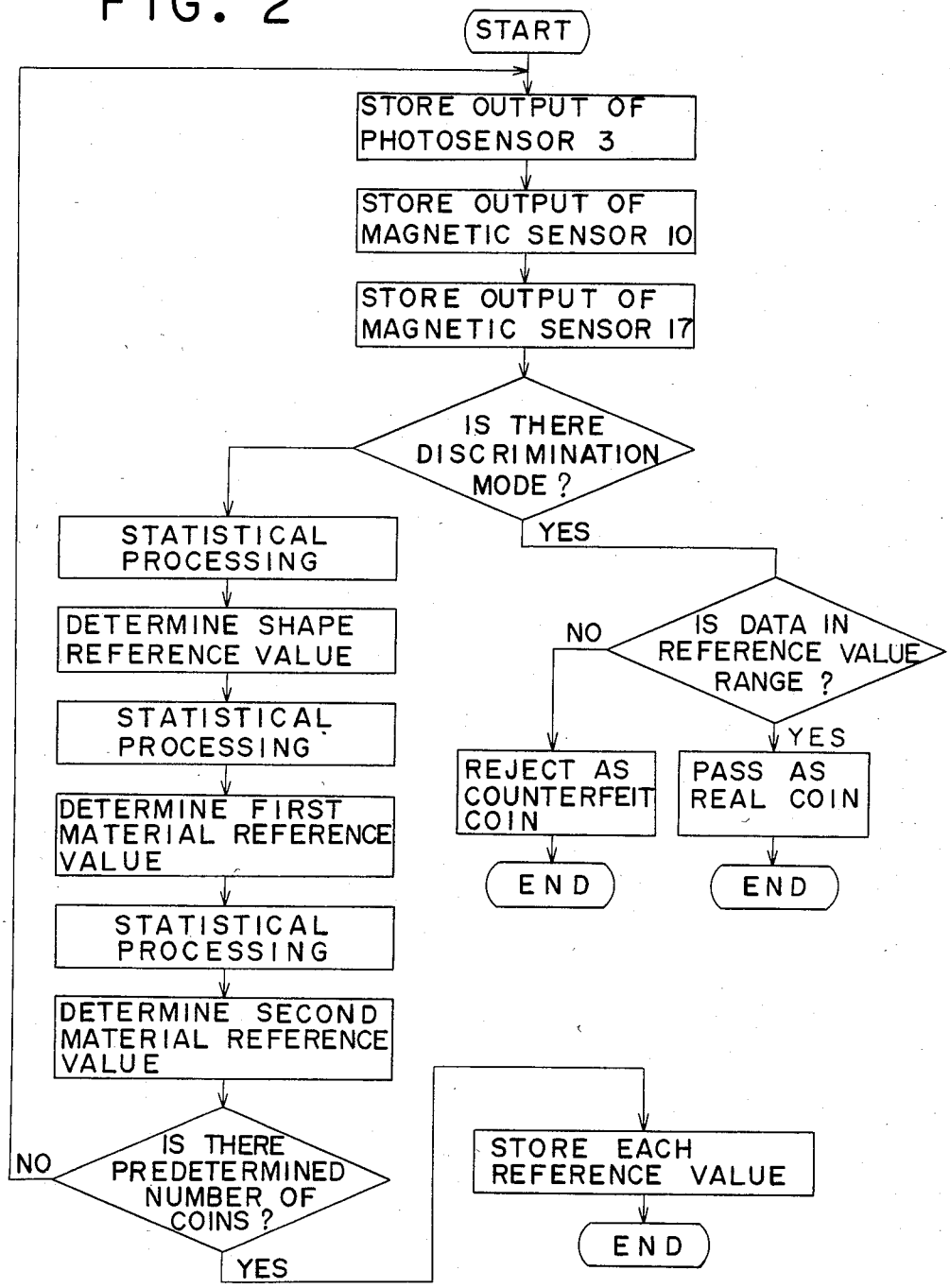
FIG. 2 is a flow chart explanatory of the operation of a microcomputer shown in FIG. 1.

The operation of the apparatus having the above construction according to the invention will now be described with reference to the flow chart of FIG. 2. First the reference value setting mode and a given sample number are set with the control switch section 25. Then, each sample of coin 2 is inserted into the apparatus from the coin slot 1*a*.

The photosensor 3 produces the data output concerning the shape of each sample coin, the data being stored in the RAM 28. The magnetic sensors 10 and 17 produce respective first and second data outputs concerning the magnetic characteristics of the material of the coin, these data being also stored. Now, the pertinent mode is checked. Since it is the reference value setting mode, a program of setting reference value data is executed. More specifically, the newly stored shape data from the photosensor 3 is statistically processed with respect to previously stored shape data. For example, the maximum and minimum reference values are calculated from the average value by adding a fixed value as a standard difference to the average value and subtracting it from the average value, or purely the maximum and minimum values are made reference values. In this way, a permissible reference value range is determined. Likewise, the first and second magnetic character data from the magnetic sensors 10 and 17 are statistically processed to determine their permissible reference value ranges. The number of sample coins is set to a value sufficient to objectively judge the fluctuations of the detection data due to the extent of wear of coins of the same kind, contamination thereof, accretion of dust thereon, etc. Usually, 100 coins are sufficient. Of course if there are fluctuations in the measurement, they can be taken into consideration to correctly judge genuineness. It is possible to repeatedly insert the same coin as a sample if it is an ideal coin perfectly free from wear or contamination.

In the above example, these inspection parameters, i.e., shape and first and second magnetic characteristics, are provided for setting the reference values. These items are provided from a consideration of the accuracy of discrimination, and it is possible to provide only a single item or two or more parameters for inspection.

When the reference values are determined with respect to the given number of sample coins, they are stored in the RAM 28. FIG. 3 is a memory map showing the storage areas of the RAM 28.

In the above way, the setting of reference values is completed. The statistical processing noted above may be performed at a time after storing all data for a given number of sample coins if there is sufficient redundancy in the storage capacity of the RAM 28.

After the reference values are set, the apparatus is ready to be used for discriminating coins by setting the discriminating mode with the switch section 25. In this mode, the data of a coin 2 inserted into the coin slot 1*a*, i.e., the shape data from the photosensor 3 and first and second magnetic characteristics data from the magnetic sensors 10 and 17, are also produced and stored as in the reference value setting mode. In the subsequent step, the mode is selected to be the discriminating mode. Now checks are carried out as to whether the stored data of the inspected coin are in the range between the minimum and maximum reference values stored in the RAM 28. These checks are carried out with respect to all the inspection parameters.

If the data are within the permissible ranges for all the inspection parameters, the inspected coin is judged to be genuine and is led through the passage 30 into a cash box 31. If there are data outside the permissible range for even a single inspection parameter, the inspected coin is judged to be counterfeit. At this time, the gate mechanism 29 is operated to lead the coin through the passage 32 into a rejected coin saucer 33.

The operations of the statistical processing of data and the storage of reference value data are executed by the microprocessor 23 according to a program stored in the ROM 26. The RAM 28 stores tentative data and permissible reference value data. The back-up battery furnishes power to the RAM 28 in the event of loss of commercial power. The reference value data once preset are held until it is necessary to replace them. The RAM 28 may be replaced with a ROM capable of writing data, i.e., an EEP ROM. In this case, the back-up battery 27 is unnecessary.

While the apparatus described above has dealt with coins, the same construction is applicable to an apparatus for discriminating bank notes or the like by merely altering the sensors. The difference of this arrangement from that relating to coins will be described with reference to FIGS. 4 and 5.

Figure 4:
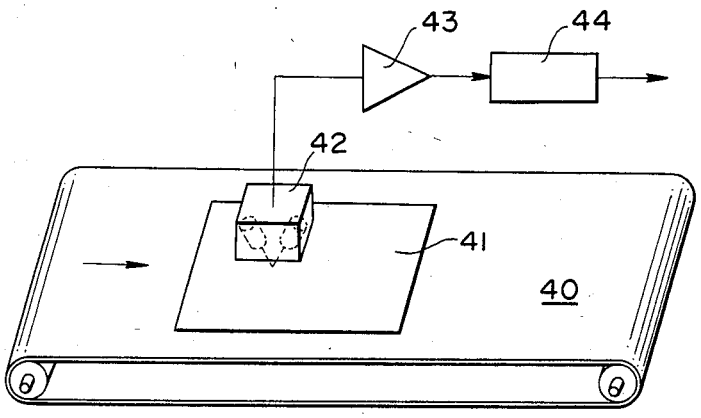
FIG. 4 is a view showing a sensor used for discrimination of a bank note.
Figure 5:
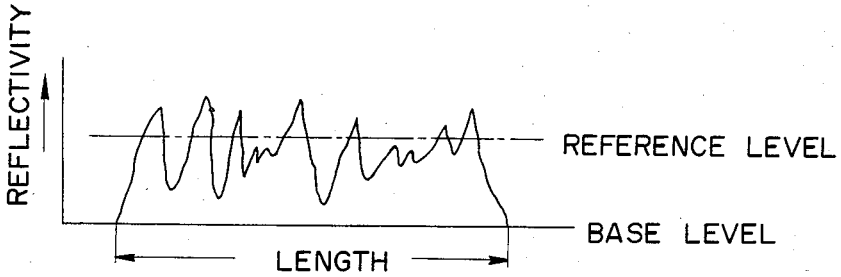
FIG. 5 is a graph showing the output waveform of the sensor shown in FIG. 4.

FIG. 4 is a perspective view showing a bank note inserting section. A bank note 41 fed on a belt 40 passes through a photosensor 42 consisting of a light-emitting section and a light-receiving section, whereby the reflectivity of the surface of the bank note 41 is detected. The detection data are fed through an amplifier 43 and a binary circuit 44. The binary circuit 44 converts the input signal into a binary signal which can assume two, i.e., "H" and "L", values according to an average level or a predetermined level. This technology is extensively employed in case of data processing of an analog signal in a microcomputer. The binary data obtained from the binary circuit 44 representing the reflectivity of the surface of the bank note (which is a pattern of data), is stored in RAM 28 by microprocessor 23 as shown in FIG. 1.

Furthermore, data representing the length (or shape) of the bank note 41 may be obtained from the output of the amplifier 43 using a comparator, in which the reflectivity level of the belt 40 (usually zero) is made a comparison level. Where these data are used, they may be fed along with the output of the binary circuit 44 to a multiplexer to produce sequential data to be fed to a microcomputer.

The shape data or pattern data obtained in the above way are statistically processed for a predetermined number of bank notes to obtain minimum and maximum reference values concerning the fluctuations of the pattern to be accepted and permissible reference pattern data are stored as in the case of coins. In the processing of detection data of the photosensor 42, the reflectivity of the bank note surface at a predetermined point thereof may be converted to digital data to obtain pattern data. As in the case of coins, described above, acceptable bank notes are discriminated with reference to the reference values stored in the manner described.

1. A method of judging the genuineness of currency by measuring inherent characteristics thereof, comprising the steps of:

sampling a predetermined plurality of pieces of currency of the same denomination at least a plurality of which have been in circulation and thus differ from each other as to the extent of wear;

measuring the inherent characteristics of said predetermined plurality of pieces of currency of the same denomination with sensor means;

calculating minimum and maximum reference values for discriminating genuine currency from the measured values of the inherent characteristics of said predetermined number of sample pieces of currency;

storing the calculated minimum and maximum reference values;

measuring the inherent characteristics of a piece of currency to be discriminated with said sensor means;

comparing the measured inherent characteristics of the inspected piece of currency with the minimum and maximum reference values to determine the inspected piece of currency to be genuine if the measured values are between said minimum and maximum reference values and counterfeit if not, and separating currency thus determined to be genuine from currency thus determined to be counterfeit.

2. The method according to claim 1, wherein said currency is coins and inherent characteristics are the shape and the material of a coin.

3. The method according to claim 2, wherein the inherent characteristics of the material are magnetic properties.

4. The method according to claim 1, wherein said currency bank notes and said characteristics are the size and pattern of a bank note.

5. An apparatus for judging the genuineness of currency by measuring the inherent characteristics thereof, comprising:

sensor means disposed on a path of transport of the currency, for measuring a plurality of the inherent characteristics thereof;

processing control means capable of providing a reference value setting mode and a discrimination mode, said processing control means being operable in said reference value setting mode to collect inherent characteristic values of a predetermined plurality of sample pieces of currency and to calculate minimum and maximum reference values for discriminating genuine currency from the collected inherent characteristic values, said processing control means being operable in said discrimination mode to determine whether a measured inherent characteristic value of a piece of currency to be discriminated lies between said minimum and maximum reference values;

means for storing said minimum and maximum reference values, said storing means being a random access memory with a back-up battery;

and means responsive to the determination of said processing control means, to separate currency thus found to be genuine from currency thus found to be counterfeit.

6. The apparatus according to claim 5, in which said separating means comprises transport path switching means for leading genuine currency and counterfeit currency to different branch paths.

7. The apparatus according to claim 6, wherein said transport path switching means is provided on said transport path after said sensor means and is driven by a solenoid to switch said two branch paths.

8. The apparatus according to claim 7, wherein said processing control means is a microcomputer.

9. The apparatus according to claim 5, wherein said currency is coins and said sensor means is a photosensor consisting of a light-emitting section and a light-receiving section and disposed on a coin transport path, for detecting the size of a coin from the period of progress thereof through it.

10. The apparatus according to claim 5, wherein said currency is coins and said sensor means is a magnetic core for detecting a magnetic property of a coin.

11. An apparatus for judging the genuineness of currency by measuring the inherent characteristics thereof, comprising:

sensor means disposed on a path of transport of the currency, for measuring a plurality of the inherent characteristics thereof;

processing control means capable of providing a reference value setting mode and a discrimination mode, said processing control means being operable in said reference value setting mode to collect inherent characteristic values of a predetermined plurality of sample pieces of currency and to calculate minimum and maximum reference values for discriminating genuine currency from the collected inherent characteristic values, said processing control means being operable in said discrimination mode to determine whether a measured inherent characteristic value of a piece of currency to be discriminated lies between said minimum and maximum reference values;

means for storing said minimum and maximum reference values, said storing means being a read-only memory capable of writing data;

and means responsive to the determination of said processing control means, to separate currency thus found to be genuine from currency thus found to be counterfeit.

12. A method of judging the genuineness of bank notes by measuring inherent characteristics thereof, comprising the steps of:

measuring the inherent characteristics of a predetermined plurality of sample bank notes of the same denomination with sensor means, said inherent characteristics being the size and an optical density of a predetermined portion of the bank notes;

calculating minimum and maximum reference values for discriminating genuine bank notes from the measured values of the inherent characteristics of said predetermined number of sample bank notes;

storing the calculated minimum and maximum reference values;

measuring the same inherent characteristics of a bank note to be discriminated with said sensor means;

comparing the measured said inherent characteristics of the inspected bank note with the minimum and maximum reference values to determine the bank note to be genuine if the measured values are between said minimum and maximum reference values and counterfeit if not, and separating bank notes thus determined to be genuine from bank notes thus determined to be counterfeit.

13. A method as claimed in claim 1, in which said predetermined plurality of pieces of currency of the same denomination is at least about 100.

* * * * *